US006029968A

United States Patent [19]

Honegger

[11] Patent Number: 6,029,968

[45] Date of Patent: Feb. 29, 2000

[54] METHOD FOR PRODUCING MULTI-LEAF PRINTED PRODUCTS CONSISTING OF SHEETS FOLDED INSIDE EACH OTHER

[75] Inventor: Werner Honegger, Bäch, Switzerland

[73] Assignee: Ferag AG, Hinwil, Switzerland

[21] Appl. No.: 08/877,746

[22] Filed: Jun. 17, 1997

[30] Foreign Application Priority Data

Jun. 19, 1996 [CH] Switzerland ..... 1533/96

[51] Int. Cl.[7] ..... B41L 43/12

[52] U.S. Cl. ..... 270/37; 270/32; 493/405; 493/415

[58] Field of Search ..... 270/58.07, 58.08, 270/58.18, 58.19, 32, 37, 52.07, 52.09, 52.14, 52.18, 52.194, 41, 9, 5.02; 493/405, 417, 262, 383, 384, 385; 83/934

[56] References Cited

U.S. PATENT DOCUMENTS

| | | | |
|---|---|---|---|
| 375,125 | 12/1887 | Clark | 412/1 |
| 1,159,459 | 11/1915 | Wood | 281/15.1 |
| 1,177,806 | 4/1916 | Riegel | 281/38 |
| 1,777,448 | 10/1930 | Rader | 412/2 |
| 2,322,647 | 6/1943 | Luce | 270/41 |
| 2,361,140 | 10/1944 | Wolf | 270/5 |
| 2,631,845 | 3/1953 | Zuckerman | 270/5.02 |
| 3,799,536 | 3/1974 | Gregoire | 270/61 |
| 3,802,326 | 4/1974 | Shore | 493/187 |
| 3,843,113 | 10/1974 | Schaffer | 493/357 |
| 3,982,746 | 9/1976 | O'Brien | 270/37 |
| 4,046,366 | 9/1977 | McCain et al. | 270/37 |
| 4,106,148 | 8/1978 | Axelrod | 412/6 |
| 4,420,148 | 12/1983 | Meadows | 270/41 |
| 4,474,566 | 10/1984 | Meadows et al. | 493/346 |
| 5,067,697 | 11/1991 | Honegger | 270/37 |
| 5,405,127 | 4/1995 | Welborn | 270/21.1 |
| 5,655,866 | 8/1997 | Bellanca | 412/1 |

FOREIGN PATENT DOCUMENTS

| | | |
|---|---|---|
| 2 375 042 | 7/1978 | France . |
| 1 107 640 | 5/1961 | Germany . |
| 1 161 469 | 1/1964 | Germany . |
| 1 411 022 | 12/1969 | Germany . |
| 3 305 760 | 8/1984 | Germany . |

*Primary Examiner*—William E. Terrell
*Assistant Examiner*—Patrick Mackey
*Attorney, Agent, or Firm*—Walter C. Farley

[57] ABSTRACT

A method with which multi-leaf printed products (50) are produced which printed products consist of a plurality of sheets folded inside each other. Especially if this kind of printed products are to be produced from a plurality of product parts, groups of loosely superimposed sheets or sheets loosely folded inside each other are to be manipulated. This manipulation is facilitated by producing intermediate products or product parts (30, 30') respectively which are easier to handle. They consist of an outer sheet (31, 31') with a first fold (34, 34') and of inner sheets (32) all sheets (31/32, 31'/32') being folded a second time in a second fold (33, 33') perpendicular to the first fold (34, 34'). The product parts (30, 30') are especially suitable for a further processing by collecting or inserting because they can be opened easily in the middle. The increased stability of the product parts in which the individual sheets hardly shift relative to each other also have advantages when collated. The first fold (34, 34') of the outer sheet (31, 31') or outer sheets are finally trimmed off.

8 Claims, 3 Drawing Sheets

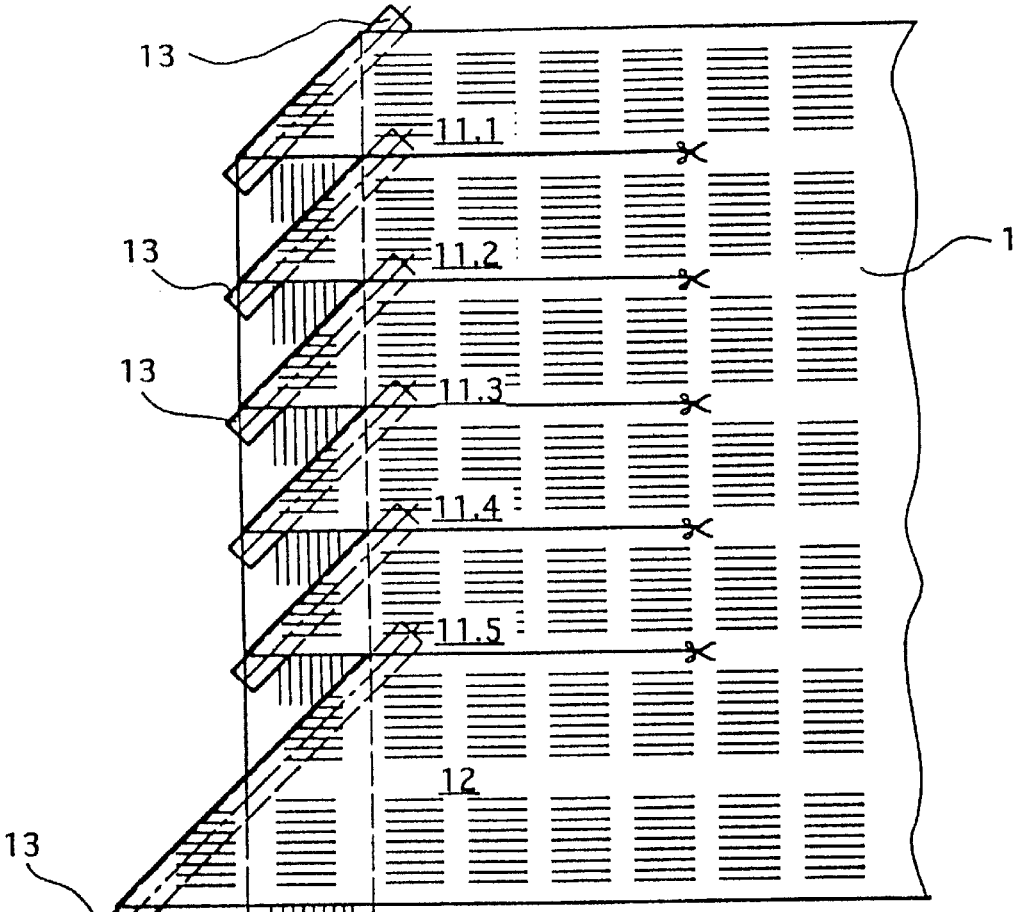
Fig. IA
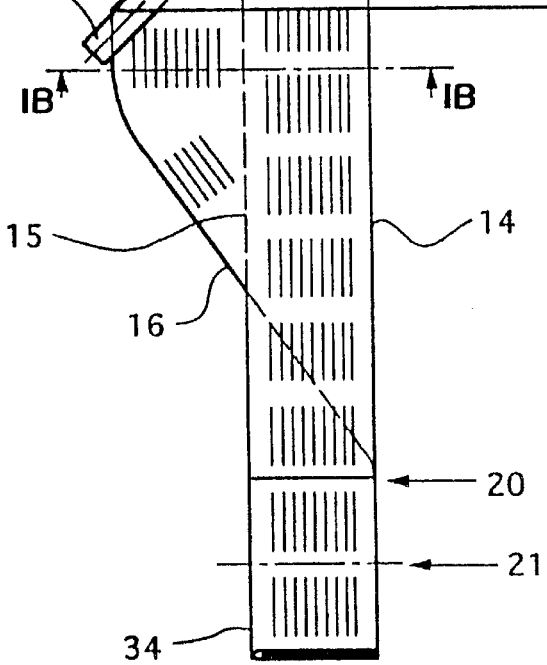
Fig. IB
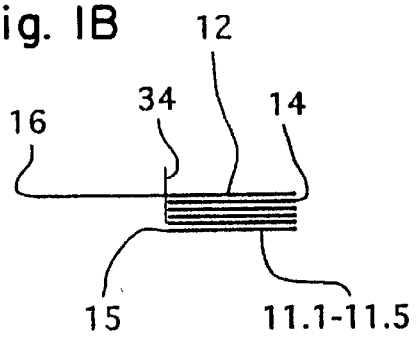
Fig. IC
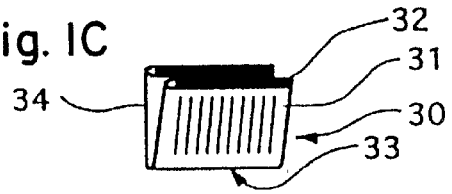

Fig. 2A
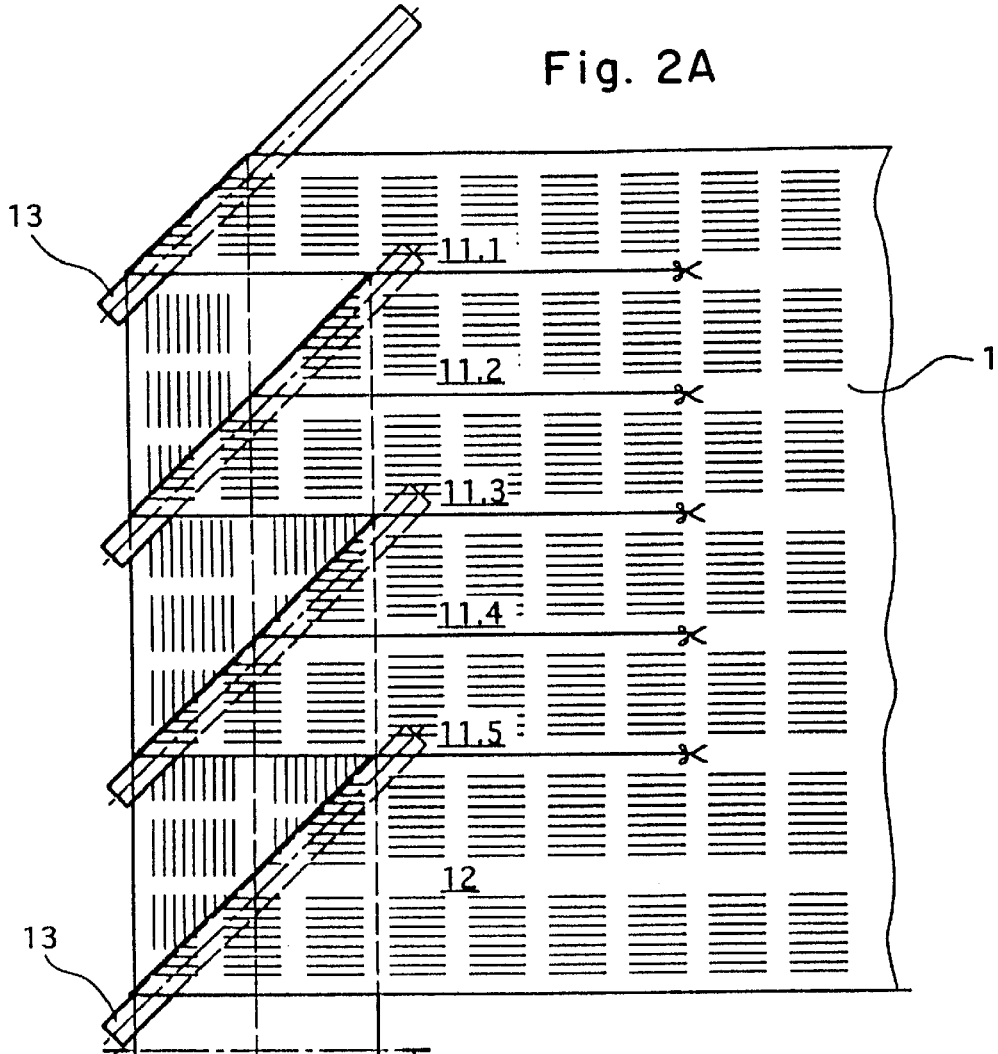
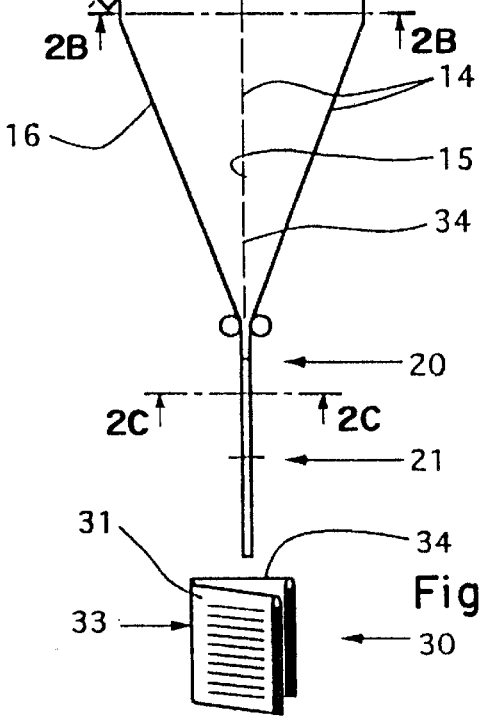
Fig. 2D
Fig. 2B
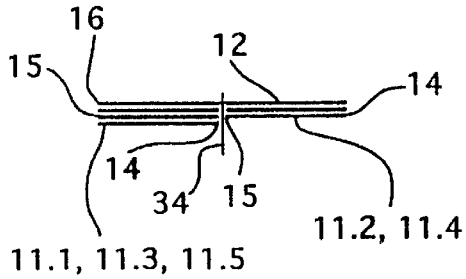
Fig. 2C
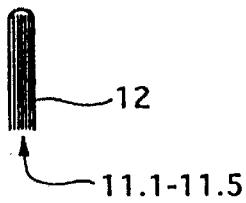

METHOD FOR PRODUCING MULTI-LEAF PRINTED PRODUCTS CONSISTING OF SHEETS FOLDED INSIDE EACH OTHER

FIELD OF THE INVENTION

The invention lies in the field of the production of printed products and concerns a method for producing multi-leaf printed products consisting of a plurality of folded sheets. The invention further concerns an intermediate product or product part of the method.

BACKGROUND OF THE INVENTION

Printed products which consist of a plurality of folded sheets are e.g. produced in intaglio printing whereby the printed paper web is cut lengthwise, the cut web parts are guided over each other, the superimposed web parts are cut transversely to form groups of superimposed sheets and the groups of superimposed sheets are folded transversely. The groups of sheets such folded inside each other (tabloids) are then normally stitched along the folding line or connected to each other with other suitable methods and are then, if required, trimmed along up to three edges.

Voluminous printed products are normally produced from a plurality of product parts as described above, whereby each product part has a smaller number of sheets. Several such product parts are brought together by collecting or inserting after folding or by collating before or after folding and are then stitched or glued (and, if required, trimmed) to form a finished product. The production via product parts allows a larger printing capacity compared to the direct production of voluminous products and facilitates the addition of additional products (stuck-in cards, sample bags etc.) and/or the application of additional printing (individualised information such as addresses etc.) on inside pages of the finished product.

However, the production via product parts also has the disadvantage that more steps are necessary, especially steps in which the groups of loosely superimposed or loosely folded sheets (product parts) must be manipulated. During these steps the product parts must be guided carefully or the sheets in the groups must be repositioned again and again, especially if the sheets consist of paper which slides easily.

Furthermore, for collecting or inserting after folding at least a part of the groups of sheets loosely folded inside each other must be opened exactly in the middle. For this purpose the sheets are usually folded off-center which facilitates the opening considerably or makes it possible at all. However, the protruding part of the sheets produced by the off-center folding must be trimmed off the finished product which increases the amount of waste considerably.

In order to facilitate manipulation and opening of the mentioned product parts consisting of sheets loosely folded inside each other, it is e.g. suggested in the publication DE-2910964 to punch a line of holes along at least one edge running perpendicular to the fold line or to slit the edges and deform them in order to create more adhesion between the sheets. An edge area treated thus, similarly to off-center folding, regards every single sheet and must be trimmed off the finished product as it is not tolerable on the finished product for aesthetic reasons.

A further known method for stabilizing the product parts which consist of loosely superimposed or loosely folded sheets is an electrostatic charging of the paper such that the paper layers adhere to each other. This is advantageous for stabilizing the layers but it may create problems in subsequent processing steps, e.g. when the product parts must be opened.

SUMMARY OF THE INVENTION

An object of the invention is to show a method for producing multi-leaf printed products consisting of sheets folded inside each other, by means of which method the difficulties encountered when manipulating groups of superimposed loose sheets and the difficulties encountered when opening folded groups of loose sheets are reduced considerably.

The central idea of the inventive method is to modify the intermediate products or product parts before folding by replacing the two outermost sheets of such a group by a folded outer sheet, whereby the folding edge of the outer sheet runs perpendicular to the folding line along which the group of sheets is then folded and whereby one edge of the inner sheets of the group lies against the inside of the fold of the folded outer sheet.

Thus the group of sheets to be manipulated as intermediate product or product part is no longer a group of sheets loosely folded inside each other but it consists of an outer sheet with a first fold in which lies a plurality of inner sheets, whereby outer and inner sheets are folded in a second fold perpendicular to the first fold of the outer sheet. Regarding stability and opening characteristics this kind of product has the advantages of a double folded product without having its disadvantages concerning the crossing point of the two folds and the not uniform thickness and it is, as will be shown below, produceable by means of a simple modification of known production methods.

The intermediate product or product part with the twice folded outer sheet is further processed in exactly the same manner as the known groups of sheets loosely folded inside each other, i.e. several such product parts are e.g. collected on top of each other or inserted inside each other and the sheets are then stitched along the fold line, or the product parts (the sheets being loose or connected) are collated and then connected to each other in the spine region. After the sheets of a product part or a plurality of product parts have been connected at least the first fold of the outer sheets are trimmed off. The waste thus produced is little compared to the waste produced by off-center folds because the trimming only concerns the outer sheet or outer sheets.

If the inner sheets are to be trimmed also, e.g. on three edges, as is often done for aesthetic reasons, trimming the first fold of the outer sheets does not require an additional method step. Due to the increased stability of the intermediate product or product part, the inner sheets, compared with the sheets of known intermediate products, stay much better aligned and therefore, the edge region of the inner sheets to be trimmed can be made minimal which again reduces the amount of waste.

Apart from the increased stability of the groups of sheets, the inventive method has, as mentioned previously, the additional advantage of facilitating the opening of the groups, i.e. it is especially suitable for production of printed products via product parts, whereby the product parts are opened when being brought together (e.g. by collecting or inserting after folding). The central opening of the described intermediate products or product parts with a double fold creates no problems and does not require high folding precision. This in contrast to the opening of known off-center folded products which leads to spoiled products or even production stops, if the width of the protruding parts shows too much variation.

Furthermore, the first folded edge of the outer sheet of the inventive intermediate product can be used as an alignment means not only for superimposing the individual intermediate products and product parts but also in a web phase (see FIGS. 1 and 2). As long as or as soon as the intermediate products or product parts are positioned such that at least a component of gravity is directed towards this folded edge the inner sheets stay aligned along this edge or will be aligned along this edge respectively.

A further advantage of the intermediate product or product part according to the inventive method compared to the known tabloid is its increased stability due to the first fold of the outer sheet. This increased stability generally facilitates the handling of the product.

BRIEF DESCRIPTION OF THE DRAWINGS

The inventive method is discussed in detail in connection with the following Figures, wherein FIGS. 1A, 1B, 1C and 2A, 2B, 2C and 2D, respectively are schematic diagrams illustrating the steps in two method embodiments for producing intermediate products or product parts with a folded outer sheet and inner sheets and positioned within the folded outer sheet.

DESCRIPTION OF PREFERRED EMBODIMENTS

Figure 3:
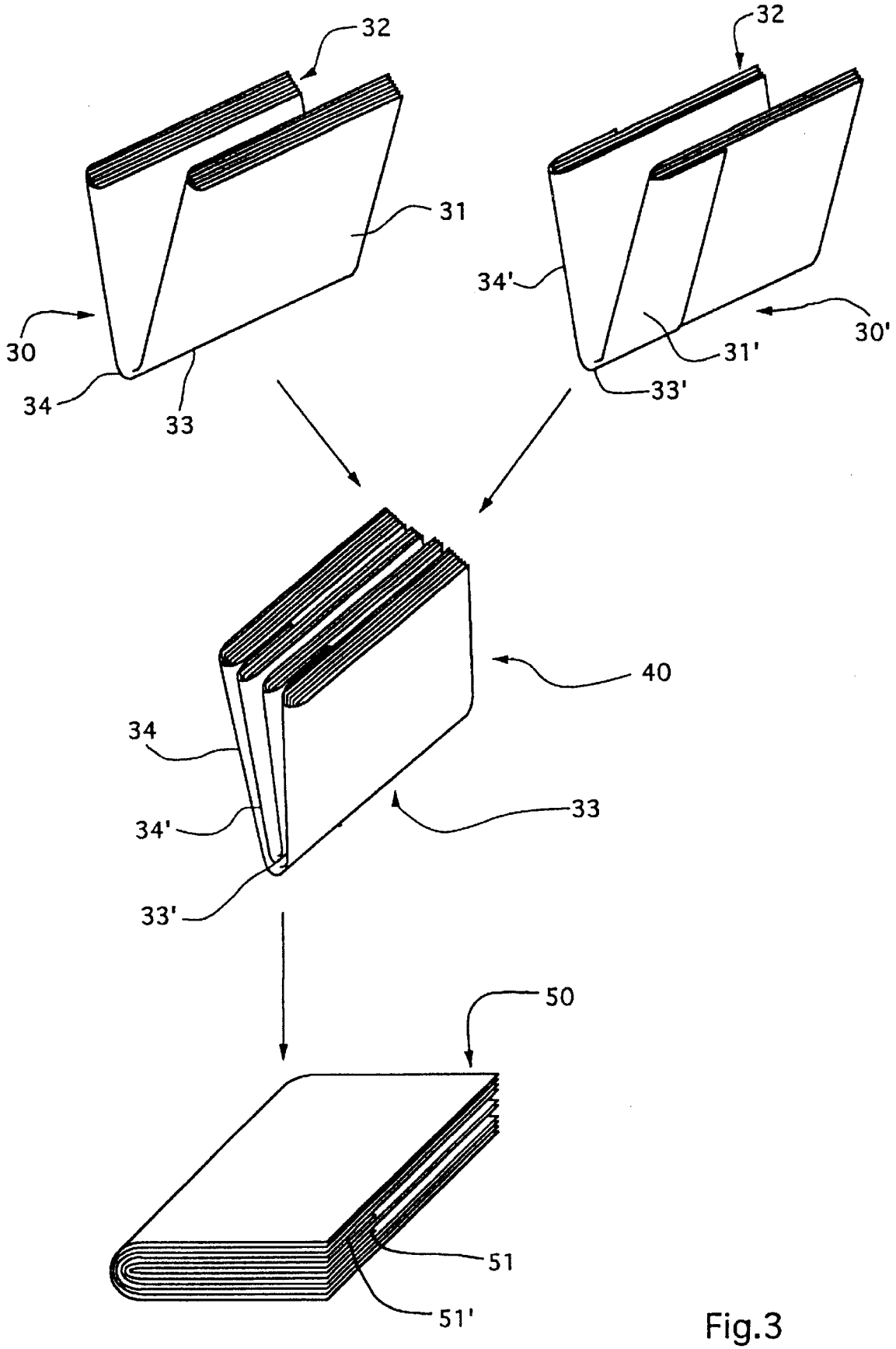
FIG. 3 is a schematic method diagram showing the steps in further processing a plurality of product parts according to FIG. 1 or 2 to produce a multi-leaf printed product which consists of a plurality of sheets folded inside each other.

FIGS. 1A, 1B and 1C show an exemplified method variant for producing the intermediate product or product part which substantially constitutes the difference between the inventive method and known methods for producing similar kinds of printed product. This method variant starts from a paper web 1 as known from intaglio printing which paper web is printed on both sides, whereby the printing represents seven part webs (seven printed pages across the width of the web).

The whole web 1 is cut lengthwise e.g. by means of a crop mark cylinder (shown diagrammatically as five small scissors) into five part webs 11.1 to 11.5 of inner sheets and a part web 12 of outer sheets, whereby the inner sheet webs are all of the same width and the outer sheet web 12 is wider, e.g. as shown substantially twice as wide as the inner sheet webs.

The webs are then turned by turning bars 13 such that they run over each other, i.e. that the longitudinal edges 14 and 15 of the inner sheet webs 11.1 to 11.5 are superimposed and that one longitudinal edge of the outer sheet web (16) protrudes over the corresponding superimposed longitudinal edges 15. If the outer sheet web 12 is, as shown, substantially twice as wide as the inner sheet webs the outer sheet web is arranged such that its one edge lies on the edges 14 of the inner sheet webs and the other edges 15 of the inner sheet webs substantially lie in the center of the outer sheet web. FIG. 1B clearly shows how the webs are positioned.

Then, the protruding part of the outer sheet web 12 is folded around the inner sheet webs superimposed on each other e.g. using a folding former (not shown) such that e.g. the two longitudinal edges of the outer sheet web 12 are positioned on edges 14 of the inner sheet webs 11.1 to 11.5 and the inner sheet webs lie between the two parts of the outer sheet web 12 folded against each other.

In this arrangement the webs 11.1 to 11.5 and 12 are cut transversely (cutting line 20) into portions with a length corresponding to the width of two printed pages such that groups of a plurality of unfolded inner sheets inside a folded outer sheet (first fold 34) are produced which are then folded transversely in their middle (folding line 21 between the two printed pages). The advantages of the inventive method affect the webs even before the cutting step in that without complicated guiding or supporting means the webs have only little tendency to be shifted relative to each other due to the effect of the folded outer sheet web. The inventive method is especially effective if the intermediate products or product parts are to be accelerated between the transverse cutting and the folding, whereby again, due to the effect of the folded outer sheet, the sheets of an intermediate product or product part cannot be shifted relative to each other or only very little.

By the method steps described above the intermediate product or product part 30 of the inventive method is produced. This product, as shown in FIG. 1C, consists of an outer sheet 31 twice folded and of a plurality of inner sheets 32 once folded. One of its edges is the second fold (transverse folding) 33 and another of its edges is formed by two superimposed parts of the first fold 34.

The intermediate product or product part 30 as shown represents, according to the further processing, a finished product with twenty-eight printed pages or twenty-eight pages of a product with a larger volume.

FIGS. 2A, 2B, 2C and 2D show a further embodiment of a method for producing the intermediate product or product part of the inventive method. This variant differs from the variant according to FIGS. 1A–1C in the positioning of the inner sheet webs 11.1 to 11.5 relative to the outer sheet web 12 and in the folding process in which the outer sheet web 12 is folded around the inner sheet webs. In FIGS. 2A–2D the same reference numbers are used as in FIGS. 1A–1C.

According to FIG. 2A the turning bars are arranged such that the inner sheet webs 11.1 to 11.5 are alternatingly positioned on the left hand side and on the right hand side of the outer sheet web 12. This can be seen from section FIG. 2B. Then the webs are superimposed e.g. with the help of a folding former such that all inner sheet webs 11.1 to 11.5 are positioned against each other and the outer sheet web 12 is folded around the inner sheet webs (FIG. 2C). The advantage of this variant compared to the variant according to FIG. 1A–B is lies in the folding process which is more symmetrical and thus can be carried out with a known folding former.

For the method variant according to FIGS. 2A–2D it is again no condition that the outer sheet web 12 is double the width of the inner sheet webs; it can e.g. also be of the same width but is e.g. positioned such that its center line lies between the inner sheet webs positioned on the left and on the right of the outer web.

The intermediate product or product part produced with the method variant according to FIGS. 2A–2D only differs from the product produced with the method variant according to FIGS. 1A–1C in the sequence of the inner sheets.

As mentioned earlier, FIGS. 1A–1C and 2A–2D merely show exemplified method variants for producing the intermediate product or product part 30. Further variants of the shown method can e.g. consist in that:

- the outer sheet web is less than twice as wide as the inner sheet webs and that it is positioned and folded relative to the inner sheet webs such that only one or none of its edges comes to lie on the longitudinal edges of the inner sheet webs (see product part 30' in FIG. 3);
- the inner sheet webs have different widths;
- the inner sheet webs and possibly the outer sheet web are multilayered, e.g. with two layers, due to the printed webs of several printing machines being united;

the outer sheet web and the inner sheet webs are produced from different main webs;

the outer sheets are folded around the inner sheets after the transverse cutting of the webs;

the intermediate product or product part which has not yet been folded transversely is produced by inserting unfolded inner sheets into a folded outer sheet.

FIG. 3 shows an exemplified method for further processing two product parts 30 and 30' which are both e.g. produced according to one of the methods as described above. Both product parts substantially comprise a doubly folded outer sheet 31 or 31' respectively and a plurality of inner sheets 32 folded once which inner sheets are all substantially of the same size. The outer sheet 31 is substantially twice as wide as the inner sheets 32 (precisely: wider than twice as wide as the inner sheets by the thickness of the superimposed inner sheets) such that it forms the two middle pages and the first and last page of the of product part 30. The outer sheet 31' has less than double the width of the inner sheets 32 and only partly covers the outer surfaces of product part 30'.

For the further processing, product part 30' is inserted into product part 30 (from-outside-to-inside method) or product part 30 is collected onto product part 30' (from-inside-to-outside method) whereby in both cases at least one of the product parts must be opened in the middle. The collected or inserted product 40 differs from a corresponding product made according to the state of the art by the edges with the first folds 34 and 34' of the two outer sheets 31 and 31'. The collected or inserted product 40 is then e.g. stitched along the second fold 33/33'.

The finished product 50 is formed by trimming off at least the edge which is formed by the first folds 34 and 34' of the outer sheets 31 and 31'. It is advantageous but not a condition that these folded edges 34 and 34' of the outer sheets 31 and 31' of the product parts 30 and 30' are all arranged on the same product edge, as is shown for product 40 in FIG. 3.

The outer sheet 31' forms two pages 51 and 51' in the finished product 50 which pages do not extend over the whole length of the spine. In a magazine this kind of pages can be used advantageously for special advertising effects.

I claim:

1. A method for producing multi-page printed products comprising the steps of producing an intermediate product consisting of a stack of loose inner sheets and a single outer sheet wherein the inner sheets are of substantially the same size as each other and are not attached to the outer sheet, folding the outer sheet once in a first fold and positioning the stack of loose inner sheets along an inside of the first fold, folding the intermediate product in a second fold along a line perpendicular to the first fold, further processing the intermediate product by connecting the inner sheets and the outer sheet together along the second fold, and trimming off the first fold.

2. A method according to claim 1 wherein the step of connecting comprises stitching the inner sheets and outer sheet together.

3. A method according to claim 1 wherein producing the intermediate product comprises superimposing a plurality of inner sheet webs by superimposing at least one lengthwise edge of the inner sheet webs, positioning an outer sheet web against the superimposed inner sheet webs and protruding over the superimposed edges, folding the protruding part of the outer sheet web around the superimposed edges of the inner sheet webs, and cutting the inner and outer sheet webs together perpendicular to their lengths.

4. A method according to claim 1 wherein producing the intermediate product comprises superimposing first and second groups of inner sheet webs by superimposing at least one lengthwise edge of the inner sheet webs, juxtaposing the two groups of inner sheet webs, positioning an outer sheet web against the juxtaposed groups of inner sheet webs, folding the outer sheet web between the juxtaposed groups of inner sheet webs, and cutting the inner and outer sheet webs together perpendicular to their lengths.

5. A method according to claim 4 and including cutting the superimposed webs transversely before forming the first fold.

6. A method according to claim 4 wherein the outer sheet web consists of a plurality of superimposed webs.

7. A method according to claim 1 wherein producing the intermediate product comprises first folding the outer sheet, and inserting the inner sheets into the folded outer sheet.

8. A method for producing multi-page printed products comprising the steps of producing an intermediate product comprising a stack of a plurality of loosely stacked inner sheets and a single outer sheet, the inner sheets being loosely positioned inside the outer sheet and the inner sheets being of substantially the same size as each other, folding the outer sheet once in a first fold and positioning the stack of loose inner sheets along an inside of the first fold, and folding the intermediate product in a second fold along a line perpendicular to the first fold and further processing the intermediate product to form a final product by connecting the inner sheets and the outer sheet together along the second fold, and trimming off the first fold of the outer sheet.

* * * * *